United States Patent [19]

Marcon et al.

[11] Patent Number: 4,799,372

[45] Date of Patent: Jan. 24, 1989

[54] PROCESS FOR FORMING HELICAL SCREW THREADS HAVING A FLANK WITH ZERO OR NEGATIVE INCLINATION

[76] Inventors: Charles Marcon, 29, rue Letchworth Zac des Noirots, 71150 Chagny; Jean Poullain, 32 avenue Boucicaut-La Verrerie, 71100 Chalon-sur-Saône, both of France

[21] Appl. No.: 923,215

[22] Filed: Oct. 27, 1986

[30] Foreign Application Priority Data

Oct. 28, 1985 [FR] France ..... 85 16324

[51] Int. Cl.[4] ..... B21H 03/00

[52] U.S. Cl. ..... 72/102; 72/103

[58] Field of Search ..... 10/152 R, 152 T; 72/80, 72/84, 91, 102, 366, 107, 103, 104, 107; 411/411, 414, 423

[56] References Cited

U.S. PATENT DOCUMENTS

| | | | |
|---|---|---|---|
| 594,661 | 11/1897 | Smith et al. | 72/84 |
| 2,467,302 | 4/1949 | Forster et al. | 72/366 |
| 3,224,799 | 12/1965 | Blose et al. | 411/411 |
| 3,446,048 | 5/1969 | Marcovitch | 72/366 |
| 3,738,139 | 6/1973 | Proops et al. | 72/69 |
| 4,373,754 | 2/1983 | Bollfras . | |

FOREIGN PATENT DOCUMENTS

| | | |
|---|---|---|
| 00511 | 2/1984 | European Pat. Off. . |
| 04352 | 11/1984 | European Pat. Off. . |
| 750373 | 1/1945 | Fed. Rep. of Germany . |
| 2359353 | 2/1978 | France . |

*Primary Examiner*—Lowell A. Larson

[57] ABSTRACT

A process for forming a helical screw thread comprising a flank with negative inclination on the wall of a rotationally symmetrical body (19) such as a metal pipe or tube. A first phase involves producing a screw thread having flanks with a positive inclination and then a second phase involves modifying the inclination of one of the flanks (24) by plastic deformation to make it negative (32). For that purpose, use is made of a roller (26) mounted on an inclined axis (X2—X2), which rolls against the flank of the thread.

18 Claims, 3 Drawing Sheets

PROCESS FOR FORMING HELICAL SCREW THREADS HAVING A FLANK WITH ZERO OR NEGATIVE INCLINATION

The process the subject-matter of this invention is concerned with the production of helical screw threads, in which at least one of the flanks is at a zero or negative inclination, on solid or hollow rotationally symmetrical bodies. In the case of hollow bodies, the process concerns the production of screw threads on the outside or inside walls thereof. Most frequently it concerns the production of screw threads at the ends of metal tubes which are assembled by screwing. The process is applied not only to the production of cylindrical helical screw threads but also conical or tapering helical screw threads.

Reference will be made to the FIGS. 1 to 4 to assist in arriving at a better understanding of the general characteristics of helical screw threads and the state of the art regarding the production thereof.

Figure 3:
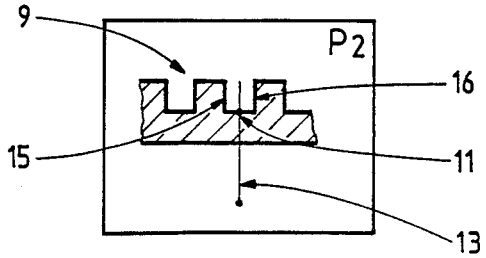
FIG. 3 is a view in half section along a plane perpendicular to a tangent to a thread of a screw thread having square threads.
Figure 4:
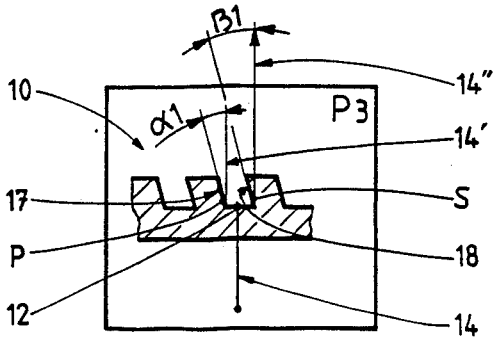

FIG. 4, like FIG. 3, is a view of a half section of a screw thread comprising threads, one of the flanks of which has negative inclination.

Figure 1:
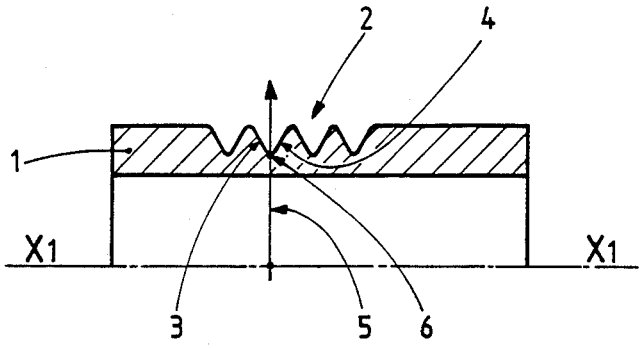
FIG. 1 is a view in axial half section of a tube provided with a helical screw thread in which the screw thread flanks are at a positive angle of inclination.

FIG. 1 shows a view in axial half section of half of a rotationally symmetrical body 1 having an axis X1—X1, on the outside wall of which are provided a number of threads of a helical screw thread 2. In the case of such a screw thread 2, the two facing flanks as shown at 3 and 4 are flanks which are referred to as being of positive inclination. In fact, the flanks which are disposed in a V-shaped configuration relative to each other meet at the root 6 of the thread. If a radius of the rotationally symmetrical body, as indicated at 5, is passed through the point 6, it is found that, on travelling along that radius from the point 6 in the outward direction of the screw thread, that is to say, in the direction indicated by the arrow, the distance from the flanks 3 and 4 of the screw thread increases. It is stated by definition that those flanks have a positive inclination. It will be noted that the same definition applies to a screw thread formed on the inside wall of a hollow rotationally symmetrical body.

The only difference which is found in that case is that, on travelling along a radius from the root of the screw thread in the outward direction of the screw thread, such movement is towards the axis of the rotationally symmetrical body instead of being away therefrom.

Figure 2:
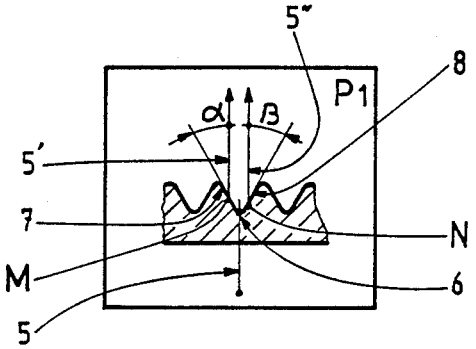
FIG. 2 is a view of the screw-threaded tube in FIG. 1, in half section along a line perpendicular to a tangent to a thread.

If the screw threads shown in FIG. 1 are cut by a plane P1 perpendicular to a tangent to the helix of the screw thread 2 and passing through the intersection at 6 between the radius 5 and the screw thread root, with the radius 5 therefore being contained in the plane P1, that gives FIG. 2. The plane P1 cuts the flanks of the screw thread in question at 7 and 8, along the generatrices thereof. In the situation shown in FIG. 2, those generatrices are straight lines but they may be of various forms depending on the types of screw thread.

Consideration should also be given to the angles of inclination of the flanks of the thread, as at 7 or 8, at any points on the generatrices thereof as at M or N. At each of those points, the angle of inclination of the generatrix is the angle formed by a tangent thereto at that point with a line parallel to the radius 5 passing through that point.

In the arrangement shown in FIG. 2, it will be seen that the angle of inclination of the flank 7 of the screw thread at the point M is equal to the angle $\alpha$ formed by the tangent to the generatrix of that flank of the screw thread at that point with the line 5' parallel to the radius 5, passing through that point. Likewise, the angle of inclination of the flank 8 of the screw thread at the point N is the angle $\beta$ formed by the tangent to the generatrix of that flank at that point with the line 5'' parallel to the radius 5, passing through that point. Those angles $\alpha$ and $\beta$ are positive as, when moving in parallel relationship to the radius 5 contained in the sectional plane, from the point M or the point N respectively in the outward direction of the screw thread, that is to say in the direction indicated by the arrowheads on the ends of the straight lines 5' and 5'', there is an increase in the distance from the tangents to the generatrices traced at those points.

The helical screw threads comprising threads with positive flanks such as those just described above are the screw threads which are most widely used as they are the easiest to produce. That is the case for example with screw threads which are in conformity with the international system (S.I.) in which the opposite flanks are each at a positive angle of 30° with respect to a radius.

Such screw threads comprising positively inclined flanks however suffer from the disadvantage that they are of inadequate mechanical strength for certain uses. That is the case for example with the screwed connection between two hollow rotationally symmetrical bodies of which one comprises a male screw thread at one of its ends and the other has a corresponding female screw thread which is engaged by screwing onto the male screw thread.

If a pulling force is applied to one of the two tubes or pipes, in parallel relationship to the common axis, thus tending to separate it from the other tube, it is found that the force which is thus applied at the location of the loaded flanks of the screw threads has a radial component. That component tends to cause the male and female flanks which are in a condition of bearing against each other to slide. If the flanks are positively inclined, that radial force tends to increase the diameter of the wall of the hollow body on which the female screw thread is provided and, on the other hand, to cause contraction of the wall of the hollow body which carries the male screw thread. In the case of hollow bodies with thin walls, the radial deformation produced may be such that the threads become disengaged from each other and the connection is then broken.

The risk of breaking the connection between such interconnected members occurs for example in the case of conduits comprising pipes or tubes of substantial diameter and small thickness, which are submitted to high tensile forces.

The ways of avoiding such dangers are known. They consist of using screw threads in which the loaded flanks have zero or negative inclination. FIGS. 3 and 4 show examples of such screw threads. As in the case of FIG. 2, the sectional planes P2 and P3 are planes which are respectively perpendicular to a tangent to the spiral of the corresponding screw thread, as at 9 and 10, and containing the radius 13 and 14 of the rotationally symmetrical body which intersects the screw thread root at 11 and 12. In FIG. 3, the generatrices of the flanks 15 and 16 of the thread are straight and parallel to the radius 13. The tangents at any point on those generatrices are therefore coincident therewith and are therefore also parallel to the radius 13. These screw threads are therefore referred to as "square" threads. It will be appreciated that an axial pulling force applied to a screw threaded connection between tubes or pipes comprising such screw threads cannot include any radial component at the flanks of the screw threads. In the arrangement shown in FIG. 4, the generatrices 17 and 18 of the flanks of the screw threads are straight and are therefore coincident with their tangents. If a line 14' parallel to the radius 14 is passed through any point P on the generatrix 17, the line 14' forms an angle $\alpha 1$ to the generatrix 17; that angle is positive and therefore the corresponding flank has a positive inclination at an angle $\alpha 1$. In contrast, a line 14'' parallel to the radius 14, passing through any point S of the generatrix 18, forms therewith a negative angle $\beta 1$. In fact, on moving along the straight line 14'' from the point S in the outward direction of the screw thread, that is to say, in the direction indicated by the arrow, the line of such movement does not increase its distance from the flank of the screw thread but on the contrary penetrates into the interior of the flank. That flank therefore has a negative inclination at an angle $\beta 1$. It is often said that this is a screw thread flank having an undercut configuration.

If a pulling force is applied to a screw threaded connection between tubes or pipes carrying such screw threads and if the loaded flanks of the screw threads are those which are at a negative angle of inclination, it is found that the radial component of the pulling force tends to tighten the two male and female screw threads against each other and therefore to increase the degree of interpenetration thereof. As in the case of flanks with a positive angle of inclination, the radial component increases, with all other things being equal, in proportion to an increasing angle of negative inclination of the load-bearing flank.

In spite of the advantages of the above-indicated screw threads with a load-bearing flank having a negative angle of inclination, the use thereof is greatly limited as they are particularly difficult to produce. In the case for example which involves machining the negative flank by turning, using a cutting tool, the cutting tool has a cutting edge whose end forms an acute angle and is therefore particularly fragile. In addition, at the root of the screw thread, the conditions involved in removal of the turnings are difficult and the surface condition produced is poor. Moreover, it is not possible to produce such screw threads by rolling as the rolling rollers used must be of the configuration of the groove to be produced and therefore do not permit operation in an undercut configuration. Experience has shown that the use of rollers whose sides have zero angles of inclination does not make it possible to produce square screw threads, but only screw threads which have a positive angle of inclination of a few degrees.

Research was carried on into the possibility of developing a method for producing helical screw threads in which the threads have a load-bearing flank with a negative inclination as well as an excellent surface condition, in particular in the region in which the negative flank is joined to the root of the screw thread. The attempt was also made to provide a method of achieving such a result, which is simple, quick and economical.

The process for producing helical screw threads having a flank with zero or negative inclination on the outside wall of rotationally symmetrical bodies and also on the inside wall in the case of hollow rotationally symmetrical bodies, being the subject-matter of the invention, comprises, in a first phase and using a method such as machining, rolling or the like, producing a helical screw thread in which the opposite flanks of each thread both have positive inclination. A second phase involves producing, by a forming means, on the flank of the screw thread which in use will be loaded, plastic deformation without the removal of material, in the course of which the inclination of said flank is made zero or negative. The forming means used is preferably a rotationally symmetrical roller which is mounted freely rotatably about an axis which is inclined at an angle of between 10° and 80° with respect to a plane perpendicular to a radius of the rotationally symmetrical body, said radius intersecting the screw thread root in the vicinity of the region in which the roller bears against the screw thread flank.

Advantageously, the generatrix of the edge of the roller, which bears against the screw thread flank, forms an angle of between 0° and −30° with a line parallel to that same radius of the rotationally symmetrical body. Preferably, the axis of the roller is in a plane perpendicular to a tangent to the helix of the screw thread, in the region in which the roller bears against the screw thread flank. By causing the axis of the roller to rotate with a relative movement in a helix around the rotationally symmetrical body and by maintaining the edge of the roller in a condition of bearing against the flank of the thread, a plastic deformation of the flank, is obtained, the generatrix of which being applied to that of the roller and therefore assuming a zero or negative inclination which is preferably between 0° and −30°. Advantageously, the generatrix of the edge of the roller which produces the plastic deformation of the flank of the thread is connected to a second forming or shaping region whose generatrix bears against the outside edge of the thread. Advantageously also, those two generatrices are at an angle of about 50° to 100° to each other. It is thus possible to control the profile of the bead or enlarged portion which tends to be formed by plastic deformation at the outside edge of the screw thread in the course of forming the screw thread flank by means of the roller. It is also possible to control the profile of the above-mentioned bead, or remove it, by any suitable method such as turning machining, milling or the like. Advantageously also, a rounded profile is imparted to the end edge of the roller and a thrust force is applied to the roller, by means of the spindle on which it is freely rotatably mounted, the thrust force being sufficient for the profile of the end edge of the roller to be reproduced in the junction region between the root of the screw thread and the flank whose inclination has been changed.

The invention also concerns a rotationally symmetrical forming roller for carrying out the process according to the invention. The roller is of the structure and characteristics as just described above, as well as those which will be set forth in greater detail in the following examples. It preferably comprises at least one substantially frustoconical forming zone. Advantageously, it has two substantially frustoconical zones which are disposed in opposite relationship by way of the small bases thereof. In that case, the two generations of such zones are advantageously at an angle of 50° to 90°.

The following examples and drawings permit the features of the process and the apparatus according to the invention to be better appreciated, without limiting the invention.

Figure 5:
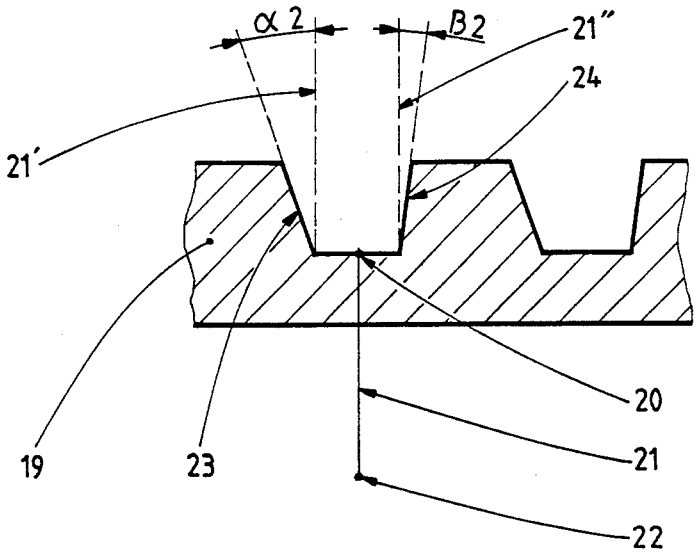
Figure 6:
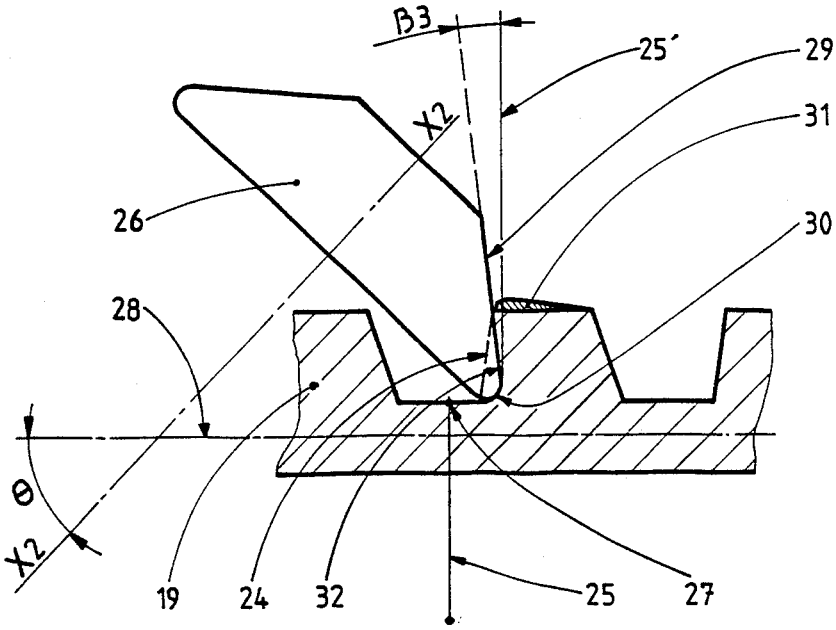
Figure 7:
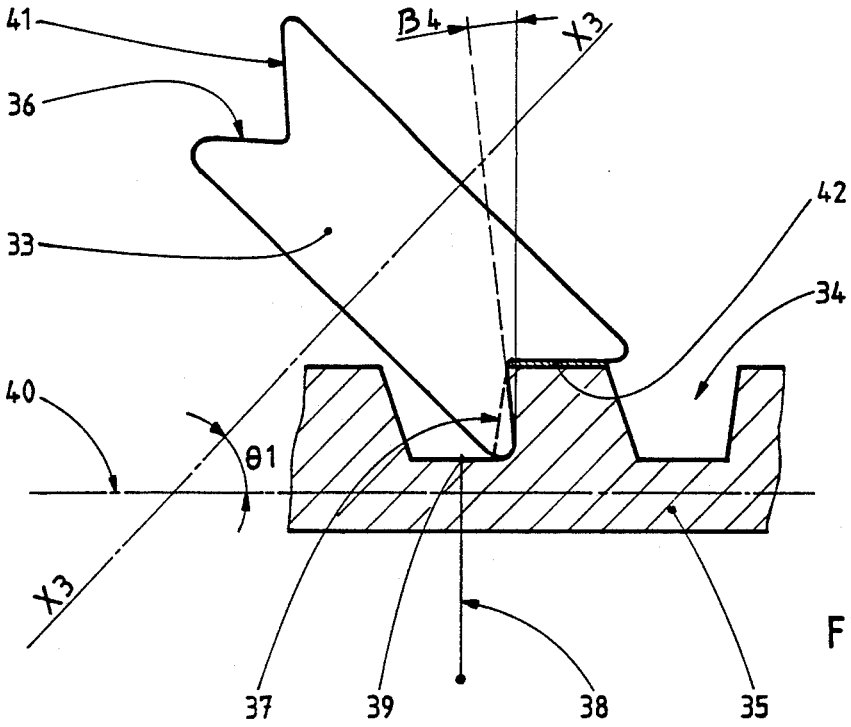

FIG. 5 shows a hollow body on which a screw thread is produced in the first phase of the process according to the invention, FIG. 6 shows the hollow body on which the second phase of the process according to the invention is carried out, and FIG. 7 is an alternative form of the second phase of the process according to the invention, using a roller permitting the outside edge of the thread to be controlled.

FIGS. 5 and 6 show an embodiment of the process according to the invention which involves producing, on the outside wall of a hollow rotationally symmetrical body 19, a screw thread comprising a flank which is capable of bearing a load, with a negative angle of inclination. The hollow body is of a material which is capable of undergoing plastic deformation such as a metal material.

In a first phase, a screw thread of which a portion is shown in FIG. 5 is produced by any suitable process such as turning. In FIG. 5, as in the case of FIGS. 2 to 4, the sectional plane is perpendicular to a tangent to the helix at the root of the screw thread at 20, at the intersection between the root and the radius 21. It will be noted that the point 22 is itself at the intersection of the axis of the hollow body 19 with the sectional plane, said axis and said plane forming relative to each other an angle equal to the angle of the helix. The opposite flanks 23 and 24 of the threads have a positive angle of inclination and are therefore easy to produce. It will be seen that at 24 the generatrix of the flank which is intended to be load-bearing in a situation of use has a real angle of inclination $\beta 2$ with respect to a line 21", parallel to the radius 21, which passes through the foot of the generatrix, at the root of the thread. The angle $\beta 2$ is positive. The same situation occurs in regard to the generatrix 23 of the opposite flank, which is at a positive angle $\alpha 2$ to a line 21', parallel to the radius 21, which passes through the foot of that generatrix.

In a second phase, as shown in FIG. 6, a roller 26 is rolled against the generatrix of the flank which is intended to be load-bearing, applying a sufficient pressure to deform that flank and to impart thereto an undercut configuration, that is to say, negative inclination. For that purpose, the roller 26 is mounted freely rotatably about an axis X2—X2 which is in the plane of the drawing which is perpendicular to the tangent to the helix at the root of the thread at point 27 at which the root and the radius 25 intersect. Moreover, the axis X2—X2 is inclined at an angle $\theta$ with respect to a plane perpendicular to that radius, the line thereof being indicated at 28.

The particular structure and characteristics of the rollers used for carrying out the process according to the invention constitute one of the subjects of the present invention.

It will be seen that the roller 26 comprises a frustoconical wall, the generatrix 29 of which is inclined so as to displace the flank 24 by a decreasing amount from the base to the crest, imparting a negative inclination to the flank 24. The negative angle $\beta 3$ of the generatrix 29 with respect to a line 25' parallel to the radius 25, which passes through the foot of that generatrix, is the angle which is imparted to the load-bearing flank after the roller 26 has passed. In order to carry out such an operation, the spindle or shaft (axis X2—X2) of the roller 26 is carried by a suitable means which makes it possible to produce in relative terms a double synchronized movement involving rotation about the body 19 and translation parallel to the axis of the body 19, in such a way that the generatrix 29 uniformly displaces the flank 24 to 32, thereby imparting thereto the required negative inclination. The end edge 30 of the roller 26 is rounded so as to connect the root of the thread to the modified flank 32. At the same time as the flank 24 is displaced by the roller to the position 32, a bead or enlarged portion 31 is formed on the outside edge of the thread. In most cases the bead 31 must then be removed by any means such as turning machining or milling.

The roller 26 is produced from a material which is sufficiently hard to permit the thread flank to be deformed, without the roller itself being deformed. The roller may be made from treated steels having high mechanical characteristics, metal carbides or other materials. The angle $\beta 2$ of positive inclination, which is imparted to the flank 24 by machining, and then the angle of negative inclination $\beta 3$ which is imparted to the same flank at 32 by the generatrix 29 of the roller 26, are determined in dependence on the characteristics of the material which makes up the rotationally symmetrical body. In most cases, the angle $\beta 2$ is about 1° to 20° and the angle $\beta 3$ is about 0° to 30°. The angle of inclination $\theta$ of the axis of the roller is between 10° and 80° and in most cases between 30° and 60°. It is determined in dependence on the characteristics of the screw thread which has to be worked, so as to produce a roller whose profile is such that it can penetrate to the bottom of the thread, while being of sufficient compactness and density that it is able to withstand the forces imposed thereon.

Instead of using a roller according to the invention, such as that shown in FIG. 6, it is advantageously possible to use a roller, also in accordance with the invention, which makes it possible to control the profile of the bead 31 which is formed on the outside edge of the thread. FIG. 7 shows a rotationally symmetrical roller 33 which is mounted freely rotatably about an axis X3—X3, being used to impart a negative inclination to the load-bearing flank of a screw thread 34 provided on the outside wall of a hollow rotationally symmetrical body 35. The roller 33 comprises a first substantially frustoconical forming or shaping zone whose generatrix 36 is inclined in such a way as to displace the flank 37 of the thread, imparting thereto a negative inclination, at an angle $\beta 4$. As in FIG. 6, the plane of FIG. 7 contains the radius 38 of the rotationally symmetrical body 35, which intersects the root of the thread at 39. That plane is perpendicular to the tangent to the helix of the screw thread at the root of the thread, passing through the point of intersection 39. The axis X3—X3 is inclined at an angle $\theta 1$ with respect to a plane perpendicular to the radius 38, the plane being shown at 40. The roller comprises a second frustoconical forming or shaping zone whose generatrix 41 connects to the generatrix 36. It will be noted that those two substantially frustoconical zones are in opposite relationship to each other by way of their small bases, thus forming an annular groove of substantially triangular section.

The second generatrix 41 is so oriented as to impart the desired profile to the outside edge of the thread. The pressure that it applies to the edge of the thread makes it possible to level out the bead which tends to be formed by plastic displacement of the metal under the effect of the first generatrix of the roller on the flank of the thread. That therefore causes such a bead to assume the form of a portion of extra thickness as at 42 which is uniformly distributed over the outside edge of the thread. Such uniformity of distribution makes it possible in most cases to avoid a subsequent machining operation.

In most cases, the generatrices as at 36 and 41 are substantially straight and form an angle of about 50° to 90° to each other.

Very many modifications may be made in the process which is the subject of the present invention, without departing from the scope thereof. In particular, the roller may be mounted on the axis X2—X2 or X3—X3 about which it is freely rotatable, in various well-known ways. Likewise, the relative displacment of the axis X2—X2 or X3—X3 with respect to the rotationally symmetrical body 19 or 35 in such a way that the edge of the roller follows with a very high degree of precision a helical path in the course of which it produces perfectly reproducible deformation of the thread flank 24 or 37 is produced by means with which the man skilled in the art is fully familiar.

The two phases which permit the process according to the invention to be carried into effect may be performed consecutively by means of integrated apparatuses or in contrast they may be carried out by means of different items of equipment which operate at the same location or at different locations. The process may be applied to screw threads of standardized types having flanks with a positive angle of inclination carried out on common industrial products, which will then be modified in the course of carrying out the second phase of the process according to the invention. The process is applied not only to the production of cylindrical screw threads, like those described in the examples, but also the production of conical or tapering screw threads. It is applied in particular to the production of cylindrical or tapering screw threads on the ends of pipes or tubes, in particular tubes or pipes which are relatively thin in relation to their diameter, said screw threads being intended to provide for connecting such tubes or pipes.

We claim:

1. A process for forming on the wall of a rotationally symmetrical body, an inside or outside helical screw thread comprising a flank with zero or negative inclination, characterised by producing in a first phase, using a method such as machining, rolling or the like, a screw thread in which the flanks of each thread (23, 24) have positive inclination and then in a second phase, using a forming means, producing plastic deformation without removing material of the thread flank (24) which will be load-bearing in use, said deformation imparting a zero or negative inclination (32) to said flank.

2. A process according to claim 1 characterised in that the forming means is a rotationally symmetrical roller (26) freely rotatable about an axis (X2—X2) inclined at an angle of between 10° and 80° with respect to a plane (28) perpendicular to a radius (25) of the rotationally symmetrical body (19), said radius intersecting the root of the thread in the vicinity of the zone in which the roller bears against the thread flank (24), and that the axis of the roller effects relative displacement in a helical configuration around the rotationally symmetrical body, in the course of which the edge of the roller is held in a condition of bearing against the thread flank with the force necessary to cause given deformation of said flank.

3. A process according to claim 2 characterised in that the generatrix (29) of the edge of the roller which bears against the thread flank (24) forms an angle ($\beta 3$) of between 0° and −30° with a line parallel to the radius (25) of the rotationally symmetrical body and that the axis of the rotationally symmetrical roller is disposed in a plane perpendicular to a tangent to the helix of the screw thread in the zone in which the roller bears against the thread flank and wherein a positive inclination of 1° to 20° is imparted in the first phase to the thread flank (24) which in use will be load-bearing, and a zero or negative inclination of 0° to 30° is imparted to said flank in the second phase, and that the angle of inclination ($\theta$) of the axis of the roller (26) is between 30° and 60°.

4. A process according to claim 2 characterised in that the generatrix (29) of the edge of the roller which bears against the thread flank (24) forms an angle ($\beta 3$) of between 0° and −30° with a line parallel to the radius (25) of the rotationally symmetrical body and that the axis of the rotationally symmetrical roller is disposed in a plane perpendicular to a tangent to the helix of the screw thread in the zone in which the roller bears against the thread flank.

5. A process according to one of claims 1, 2 or 3 characterised by controlling the profile of the bead which tends to be formed on the outside edge of the thread of which a flank is in the course of undergoing plastic deformation, by means of a roller (33) comprising two forming zones having corresponding generatrices, one (36) thereof bearing against the flank of the thread to be deformed and the other (41) bearing against the outside edge of said same thread.

6. A process according to claim 5 characterized in that the end edge (30) of the roller has a rounded profile which is reproduced in the course of the second phase in the connecting region between the root of the thread and the flank against which the roller bears.

7. A process according to claim 6 characterized in that a positive inclination of 1° to 20° is imparted in the first phase to the thread flank (24) which in use will be load-bearing, and a zero or negative inclination of 0° to 30° is imparted to said flank in the second phase, and that the angle of inclination ($\theta$) of the axis of the roller is between 30° and 60°.

8. A process according to claim 7 characterized in that the helical screw thread is tapering.

9. Use of the process according to claim 8 for the production of cylindrical or tapering screw threads on the ends of pipes or tubes, said screw threads being intended to provide for the connection thereof.

10. A process according to one of claims 1, 2 or 4 characterised in that removal of the outside bead (31) which is formed on the edge of the thread in the course of the second phase is effected by turning, milling or the like.

11. A process according to one of claims 2 or 4 characterised in that the end edge (30) of the roller has a rounded profile which is reproduced in the course of the second phase in the connecting region between the root of the thread and the flank against which the roller bears.

12. A process according to one of claims 1, 2 or 4 characterised in that a positive inclination of 1° to 20° is imparted in the first phase to the thread flank (24) which in use will be load-bearing, and a zero or negative inclination of 0° to 30° is imparted to said flank in the second phase, and that the angle of inclination ($\theta$) of the axis of the roller is between 30° and 60°.

13. A process according to one of claims 1, 2 or 4 characterised in that the helical screw thread is tapering.

14. Use of the process according to one of claims 1, 2 or 4 for the production of cylindrical or tapering screw threads on the ends of pipes or tubes, said screw threads being intended to provide for the connection thereof.

15. In combination with a forming apparatus having means for causing the axis of a rotationally symmetrical forming roller to rotate with a relative helical movement around a rotationally symmetrical body for forming on the wall of a rotationally symmetrical body an inside or outside helical screw thread comprising a flank with zero or negative inclination, a rotationally symmetrical forming roller (26) having at least one substantially frustoconical forming zone operatively mounted on said forming apparatus with said frustoconical forming zone in deforming contact with the flank of the helical screw thread to be imparted with zero or negative inclination.

16. A forming roller according to claim 15 characterised in that the large-diameter edge of at least one substantially frustoconical zone has a profile (30) corresponding to that of the region connecting the root of the thread to the flank after deformation.

17. A forming roller according to claim 15 characterised in that it comprises two substantially frustoconical zones which are disposed in opposite relationship by way of their small bases.

18. A forming roller according to claim 17 characterised in that the generatrices of the two frustoconical zones form an angle of 50° to 90° to each other.

* * * * *

UNITED STATES PATENT AND TRADEMARK OFFICE

CERTIFICATE OF CORRECTION

PATENT NO. : 4,799,372

DATED : January 24, 1989

INVENTOR(S) : Charles Marcon et al

It is certified that error appears in the above-identified patent and that said Letters Patent is hereby corrected as shown below:

On the Title Page, Item [73] Assignee:

should read -- ESCOFIER TECHNOLOGIE SA
Chalon-sur-Saone Cedex, FRANCE --.

Signed and Sealed this

Eighth Day of August, 1989

*Attest:*

DONALD J. QUIGG

*Attesting Officer*

*Commissioner of Patents and Trademarks*